US007021957B2

(12) United States Patent
Sweetland et al.

(10) Patent No.: US 7,021,957 B2
(45) Date of Patent: Apr. 4, 2006

(54) WOVEN MULTIPLE-CONTACT CONNECTOR

(75) Inventors: Matthew Sweetland, Bedford, MA (US); Nam P. Suh, Sudbury, MA (US)

(73) Assignee: Tribotek, Inc., Burlington, MA (US)

( * ) Notice: Subject to any disclaimer, the term of this patent is extended or adjusted under 35 U.S.C. 154(b) by 0 days.

(21) Appl. No.: 11/046,975

(22) Filed: Jan. 31, 2005

(65) Prior Publication Data

US 2005/0130486 A1 Jun. 16, 2005

Related U.S. Application Data

(62) Division of application No. 10/273,241, filed on Oct. 17, 2002, now Pat. No. 6,942,496.

(60) Provisional application No. 60/348,588, filed on Jan. 15, 2002.

(51) Int. Cl.
*H01R 11/20* (2006.01)

(52) U.S. Cl. ..... 439/405; 439/67

(58) Field of Classification Search ..... 439/67, 439/66, 91, 482, 329, 493, 496, 930, 405
See application file for complete search history.

(56) References Cited

U.S. PATENT DOCUMENTS

| | | | | |
|---|---|---|---|---|
| 1,012,030 | A | 12/1911 | Underwood | |
| 3,197,555 | A | 7/1965 | Mittler | |
| 3,257,500 | A | 6/1966 | Rusch, Jr. et al. | |
| 3,371,250 | A | 2/1968 | Ross et al. | |
| 3,495,028 | A | 2/1970 | Ross | |
| 3,631,298 | A | 12/1971 | Davis | |
| 3,639,978 | A * | 2/1972 | Schurman | 29/837 |
| 3,654,381 | A | 4/1972 | Copp | |
| 3,676,923 | A | 7/1972 | Reimer | |
| 3,702,895 | A | 11/1972 | de Sio | |
| 3,711,627 | A | 1/1973 | Mariuglov | |
| 3,909,508 | A | 9/1975 | Ross | |
| 3,927,284 | A | 12/1975 | Andersson | |
| 3,984,622 | A * | 10/1976 | Ross | 174/72 A |
| 4,082,423 | A | 4/1978 | Glista et al. | |
| 4,123,899 | A | 11/1978 | Windelbandt | |
| 4,218,581 | A | 8/1980 | Suzuki | |
| 4,283,797 | A * | 8/1981 | Seider | 2/151 |
| 4,462,657 | A | 7/1984 | Snowdon et al. | |
| 4,463,323 | A | 7/1984 | Piper | |
| 4,508,401 | A | 4/1985 | Casciotti et al. | |
| 4,518,648 | A | 5/1985 | Miyata et al. | |
| 4,639,054 | A | 1/1987 | Kersbergen | |

(Continued)

FOREIGN PATENT DOCUMENTS

EP 0512714 A1 11/1992

(Continued)

*Primary Examiner*—J. F. Duverne
(74) *Attorney, Agent, or Firm*—Wolf, Greenfield & Sacks, P.C.

(57) ABSTRACT

A multiple-contact woven connector including a weave arranged to provide a plurality of tensioned fibers and a conductor woven with the plurality of tensioned fibers so as to form a plurality of peaks and valleys along a length of the conductor. The conductor has a plurality of contact points positioned along the length of the conductor, such that when the conductor engages a conductor of a mating connector element, at least some of the plurality of contact points provide an electrical connection between the conductor of the multiple-contact woven connector and the conductor of the mating connector element. The tensioned fibers of the weave provide a predetermined contact force between the at least some of the plurality of contact points of the conductor of the multiple-contact woven connector and the conductor of the mating connector element.

19 Claims, 14 Drawing Sheets

U.S. PATENT DOCUMENTS 4,651,163 A 3/1987 Sutera et al.
4,710,594 A 12/1987 Walling et al.
4,741,707 A 5/1988 Mondor, III
4,755,422 A 7/1988 Headrick et al.
4,778,950 A 10/1988 Lee et al.
4,820,170 A 4/1989 Redmond et al.
4,929,803 A 5/1990 Yoshida et al.
4,940,426 A 7/1990 Redmond et al.
4,956,524 A 9/1990 Karkow
5,015,197 A * 5/1991 Redmond et al. ..... 439/329
5,070,605 A 12/1991 Daglow et al.
5,109,596 A 5/1992 Driller et al.
5,163,837 A 11/1992 Rowlette, Sr.
5,176,535 A * 1/1993 Redmond et al. ..... 439/495
5,190,471 A 3/1993 Barile et al.
5,273,438 A 12/1993 Bradley et al.
5,447,442 A 9/1995 Swart
5,468,164 A 11/1995 DeMissey
5,469,072 A 11/1995 Williams et al.
5,533,693 A 7/1996 Abildskov
5,635,677 A 6/1997 Wood et al.
5,645,459 A 7/1997 Fitting
5,880,402 A 3/1999 Nugent
5,899,755 A 5/1999 Kline
5,899,766 A 5/1999 DeFeo
6,102,746 A 8/2000 Nania et al.
6,135,783 A 10/2000 Rathburn
6,210,771 B1 4/2001 Post et al.
6,250,966 B1 6/2001 Hashimoto et al.
6,264,476 B1 7/2001 Li et al.
6,313,523 B1 11/2001 Morris et al.
6,439,894 B1 8/2002 Li
6,483,925 B1 * 11/2002 Shen et al. ..... 381/370
6,762,941 B1 7/2004 Roth
6,852,395 B1 2/2005 Dhawan et al.
2002/0016108 A1 2/2002 Creze
2002/0117791 A1 8/2002 Hembree et al.
2003/0176083 A1 9/2003 Li et al.

FOREIGN PATENT DOCUMENTS

EP 0 901 191 A2 3/1999
EP 0 932 172 A2 7/1999
JP 6 118 818 8/1986
JP 6 176 624 6/1994
JP 6 251 819 9/1994
JP 7 037 433 2/1995
JP 8 106 939 4/1996
WO WO 95/08910 3/1995
WO WO 01/75788 A1 10/2001

* cited by examiner

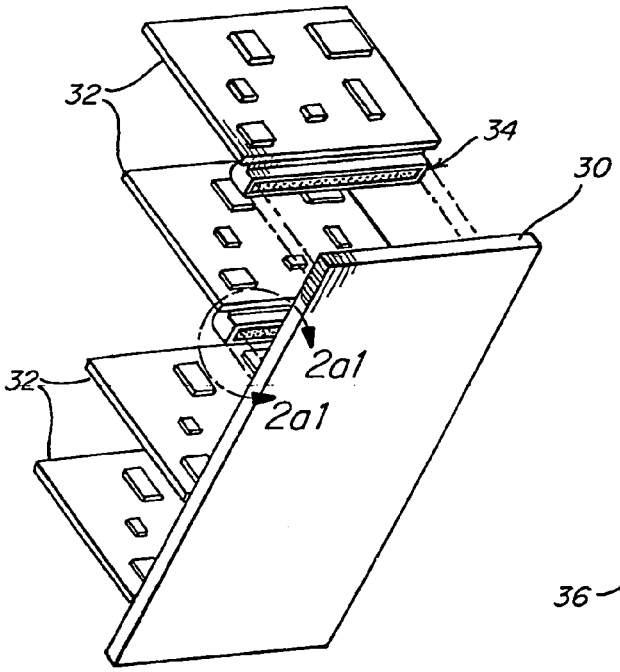
Fig. 2a
(PRIOR ART)
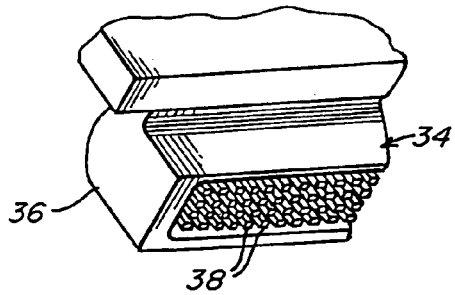
Fig. 2a1
(PRIOR ART)
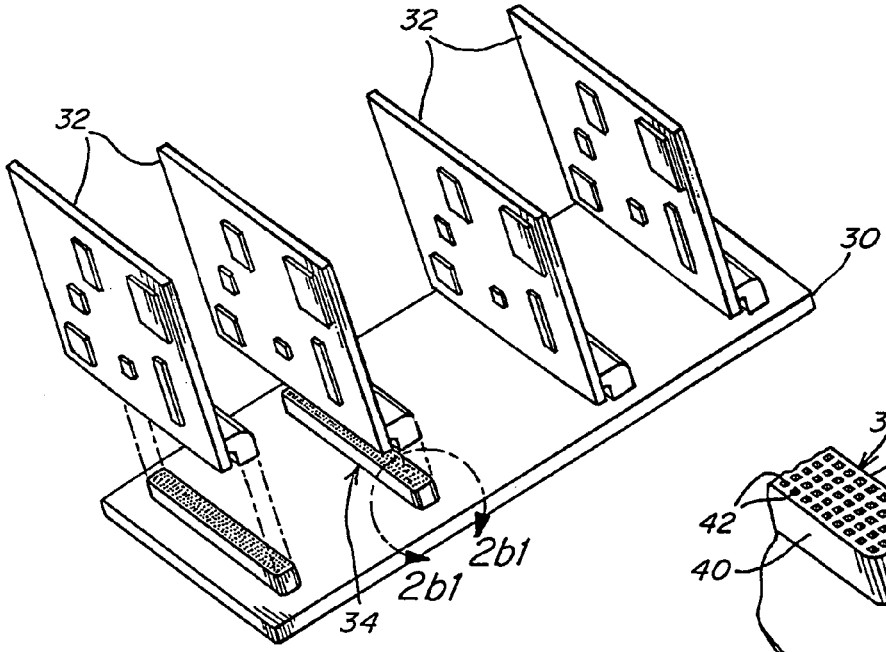
Fig. 2b
(PRIOR ART)
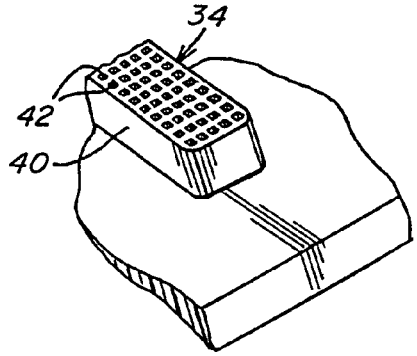
Fig. 2b1
(PRIOR ART)

80
84
91
90
96
104
96
104
90
86
116
89
118a
118b
120

86
88
80
84
104
90
86
96
96
116
120
89
118a
120
118b

WOVEN MULTIPLE-CONTACT CONNECTOR

CROSS-REFERENCE TO RELATED APPLICATIONS

This application is a continuation application and claims the benefit of U.S. Ser. No. 10/273,241, filed Oct. 17, 2002 now U.S. Pat. No. 6,942,496 which is hereby incorporated by reference in its entirety and which claims the benefit of U.S. Provisional Application Ser. No. 60/348,588 filed on Jan. 15, 2002.

BACKGROUND

1. Field of the Invention

The present invention is directed to electrical connectors, and in particular to woven electrical connectors.

2. Discussion of Related Art

Components of electrical systems sometimes need to be interconnected using electrical connectors to provide an overall, functioning system. These components may vary in size and complexity, depending on the type of system. For example, referring to FIG. 1, a system may include a backplane assembly comprising a backplane or motherboard 30 and a plurality of daughter boards 32 that may be interconnected using a connector 34, which may include an array of many individual pin connections for different traces etc., on the boards. For example, in telecommunications applications where the connector connects a daughter board to a backplane, each connector may include as many as 2000 pins or more. Alternatively, the system may include components that may be connected using a single-pin coaxial or other type of connector, and many variations in-between. Regardless of the type of electrical system, advances in technology have led electronic circuits and components to become increasingly smaller and more powerful. However, individual connectors are still, in general, relatively large compared to the sizes of circuit traces and components.

Referring to FIGS. 2*a* and 2*b*, there are illustrated perspective views of the backplane assembly of FIG. 1. FIG. 2*a* also illustrates an enlarged section of the male portion of connector 34, including a housing 36 and a plurality of pins 38 mounted within the housing 36. FIG. 2*b* illustrates an enlarged section of the female portion of connector 34 including a housing 40 that defines a plurality of openings 42 adapted to receive the pins 38 of the male portion of the connector.

A portion of the connector 34 is shown in more detail in FIG. 3*a*. Each contact of the female portion of the connector includes a body portion 44 mounted within one of the openings (FIG. 2*b*, 42). A corresponding pin 38 of the male portion of the connector is adapted to mate with the body portion 44. Each pin 38 and body portion 44 includes a termination contact 48. As shown in FIG. 3*b*, the body portion 44 includes two cantilevered arms 46 adapted to provide an "interference fit" for the corresponding pin 38. In order to provide an acceptable electrical connection between the pin 38 and the body portion 44, the cantilevered arms 46 are constructed to provide a relatively high clamping force. Thus, a high normal force is required to mate the male portion of the connector with the female portion of the connector. This may be undesirable in many applications, as will be discussed in more detail below.

When the male portion of the conventional connector is engaged with the female portion, the pin 38 performs a "wiping" action as it slides between the cantilevered arms 46, requiring a high normal force to overcome the clamping force of the cantilevered arms and allow the pin 38 to be inserted into the body portion 44. There are three components of friction between the two sliding surfaces (the pin and the cantilevered arms) in contact, namely asperity interactions, adhesion and surface plowing. Surfaces, such as the pin 38 and cantilevered arms 46, that appear flat and smooth to the naked eye are actually uneven and rough under magnification. Asperity interactions result from interference between surface irregularities as the surfaces slide over each other. Asperity interactions are both a source of friction and a source of particle generation. Similarly, adhesion refers to local welding of microscopic contact points on the rough surfaces that results from high stress concentrations at these points. The breaking of these welds as the surfaces slide with respect to one another is a source of friction.

In addition, particles may become trapped between the contacting surfaces of the connector. For example, referring to FIG. 4*a*, there is illustrated an enlarged portion of the conventional connector of FIG. 3*b*, showing a particle 50 trapped between the pin 38 and cantilevered arm 46 of connector 34. The clamping force 52 exerted by the cantilevered arms must be sufficient to cause the particle to become partially embedded in one or both surfaces, as shown in FIG. 4*b*, such that electrical contact may still be obtained between the pin 38 and the cantilevered arm 46. If the clamping force 52 is insufficient, the particle 50 may prevent an electrical connection from being formed between the pin 38 and the cantilevered arm 46, which results in failure of the connector 34. However, the higher the clamping force 52, the higher must be the normal force required to insert the pin 38 into the body portion 44 of the female portion of the connector 34. When the pin slides with respect to the arms, the particle cuts a groove in the surface(s). This phenomenon is known as "surface plowing" and is a third component of friction.

Referring to FIG. 5, there is illustrated an enlarged portion of a contact point between the pin 38 and one of the cantilevered arms 46, with a particle 50 trapped between them. When the pin slides with respect to the cantilevered arm, as indicated by arrow 54, the particle 50 plows a groove 56 into the surface 58 of the cantilevered arm and/or the surface 60 of the pin. The groove 56 causes wear of the connector, and may be particularly undesirable in gold-plated connectors where, because gold is a relatively soft metal, the particle may plow through the gold-plating, exposing the underlying substrate of the connector. This accelerates wear of the connector because the exposed connector substrate, which may be, for example, copper, can easily oxidize. Oxidation can lead to more wear of the connector due to the presence of oxidized particles, which are very abrasive. In addition, oxidation leads to degradation in the electrical contact over time, even if the connector is not removed and re-inserted.

One conventional solution to the problem of particles being trapped between surfaces is to provide one of the surface with "particle traps." Referring to FIGS. 6*a–c*, a first surface 62 moves with respect to a second surface 64 in a direction shown by arrow 66. When the surface 64 is not provided with particle traps, a process called agglomeration causes small particles 68 to combine as the surfaces move and form a large agglomerated particle 70, as illustrated in the sequence of FIGS. 6*a*–6*c*. This is undesirable, as a larger particle means that the clamping force required to break through the particle, or cause the particle to become embedded in one or both of the surfaces, so that an electrical connection can be established between surface 62 and surface 64 is very high. Therefore, the surface 64 may be provided with particle traps 72, as illustrated in FIGS. 6*d*–6*g*, which are small recesses in the surface as shown. When surface 62 moves over surface 64, the particle 68 is pushed into the particle trap 72, and is thus no longer available to cause plowing or to interfere with the electrical connection between surface 62 and surface 64. However, a disadvantage of these conventional particle traps is that it is significantly more difficult to machine surface 64 with traps than without, which adds to the cost of the connector. The particle traps also produce features that are prone to increased stress and fracture, and thus the connector is more likely to suffer a catastrophic failure than if there were no particle traps present.

SUMMARY OF THE INVENTION

According to one embodiment, a multiple-contact woven connector may comprise a weave arranged to provide a plurality of tensioned fibers and at least one conductor woven with the plurality of tensioned fibers so as to form a plurality of peaks and valleys along a length of the at least one conductor. The at least one conductor has a plurality of contact points positioned along the length of the at least one conductor, such that when the at least one conductor engages a conductor of a mating connector element, at least some of the plurality of contact points provide an electrical connection between the at least one conductor of the multiple-contact woven connector and the conductor of the mating connector element. The tensioned fibers of the weave provide a contact force between the at least some of the plurality of contact points of the at least one conductor of the multiple-contact woven connector and the conductor of the mating connector element.

According to another embodiment, an electrical connector comprises a first connector element comprising a weave including a plurality of non-conductive fibers and at least one conductor woven with the plurality of non-conductive fibers, the at least one conductor having a plurality of contact points along a length of the at least one conductor. The electrical connector further comprises a mating connector element that includes a rod member, wherein the first connector element and the mating connector element are adapted to engage such that at least some of the plurality of contact points of the first connector element contact the rod member of the mating connector element to provide an electrical connection between the first connector element and the mating connector element. The plurality of non-conductive fibers are tensioned so as to provide contact force between the at least some of the plurality of contact points of the first connector element contact the rod member of the mating connector.

In another embodiment, an electrical connector comprises a base member, first and second conductors mounted to the base member, and at least one elastomeric band that encircles the first and second conductors. The first and second conductors have an undulating form along a length of the first and second conductors so as to include a plurality of contact points along the length of the first and second conductors.

An array of connector elements, according to one embodiment, comprises at least one power connector element and a plurality of signal connector elements. Each signal connector element comprises a weave including a plurality of non-conductive fibers and first and second conductors woven with the plurality of non-conductive fibers so as to form a plurality of peaks and valleys along a length of each of the first and second conductors, wherein the second conductor is located adjacent the first conductor, and a first one of the plurality of non-conductive fibers passes under a first peak of the first conductor and over a first valley of the second conductor. The first and second conductors have a plurality of contact points positioned along the length of the first and second conductors, the plurality of contact points adapted to provide an electrical connection between the first and second conductors of the signal connector element and a conductor of a mating signal connector element, and a contact force between the plurality of contact points of the first and second conductors of the signal connector element and the conductor of a mating signal connector element is provided by a tension of the weave.

According to yet another embodiment, an electrical connector comprises a housing including a base member and two opposing end walls, a plurality of non-conductive fibers mounted between the opposing end walls of the housing such that a predetermined tension is provided in the plurality of non-conductive fibers, and a first termination contact mounted to the base member and having a first plurality of conductors connected to a first end of the first termination contact, wherein the first plurality of conductors are woven with the plurality of non-conductive fibers to form a woven structure such that each conductor of plurality of conductors has a plurality of contact points along a length of each conductor.

Another embodiment includes an electrical connector array comprising a first housing element including a base portion and two opposing end walls, a plurality of non-conductive fibers mounted between the opposing end walls, a first conductor woven with the plurality of non-conductive fibers to provide a first electrical contact, a second conductor woven with the plurality of non-conductive fibers to provide a second electrical contact, and at least one insulating strand woven with the plurality of non-conductive fibers and positioned between the first and second conductors to electrically isolate the first electrical contact from the second electrical contact.

According to yet another embodiment, a multiple-contact woven connector comprises a weave including a plurality of tensioned, non-conductive fibers and first and second conductors woven with the plurality of tensioned, non-conductive fibers so as to form a plurality of peaks and valleys along a length of each of the first and second conductors. The second conductor is located adjacent the first conductor, and a first one of the plurality of tensioned non-conductive fibers passes under a first peak of the first conductor and over a first valley of the second conductor. The first and second conductors have a plurality of contact points positioned along the length of the first and second conductors, such that when the first and second conductors engage a conductor of a mating connector element, at least some of the plurality of contact points provide an electrical connection between the first and second conductors of the multiple-contact woven connector and the conductor of the mating connector element, wherein the plurality of tensioned, non-conductive fibers of the weave provide a contact force between the at least some of the plurality of contact points of the first and second conductors and the conductor of the mating connector element.

BRIEF DESCRIPTION OF THE DRAWINGS

The foregoing and other features and advantages of the present invention will be apparent from the following nonlimiting discussion of various embodiments and aspects thereof with reference to the accompanying drawings, in which like reference numerals refer to like elements throughout the different figures. The drawings are provided for the purposes of illustration and explanation, and are not intended as a definition of the limits of the invention. In the drawings.

FIG. 2*a* is a perspective view of a conventional backplane assembly showing an enlarged portion of a conventional male connector element;

FIG. 2*b* is a perspective view of a conventional backplane assembly showing an enlarged portion of a conventional female connector element;

DETAILED DESCRIPTION

Figure 1:
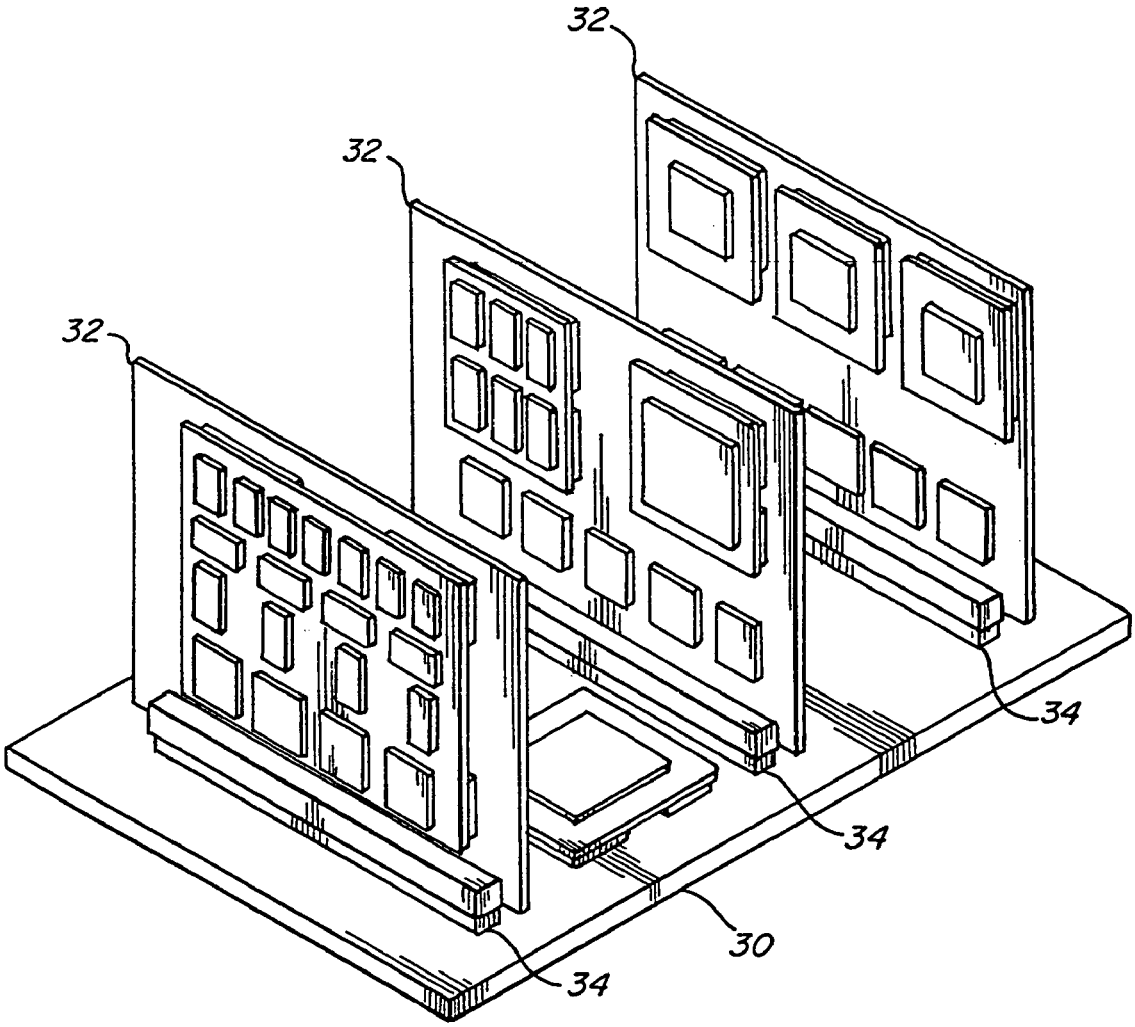
Fig. 1 (PRIOR ART)
FIG. 1 is a perspective view of a conventional backplane assembly.

The present invention provides an electrical connector that may overcome the disadvantages of prior art connectors. The invention comprises an electrical connector capable of very high density and using only a relatively low normal force to engage a connector element with a mating connector element. It is to be understood that the invention is not limited in its application to the details of construction and the arrangement of components set forth in the following description or illustrated in the drawings. Other embodiments and manners of carrying out the invention are possible. Also, it is to be understood that the phraseology and terminology used herein is for the purpose of description and should not be regarded as limiting. The use of "including," "comprising," or "having" and variations thereof is meant to encompass the items listed thereafter and equivalents thereof as well as additional items. In addition, it is to be appreciated that the term "connector" as used herein refers to each of a plug and jack connector element and to a combination of a plug and jack connector element, as well as respective mating connector elements of any type of connector and the combination thereof. It is also to be appreciated that the term "conductor" refers to any electrically conducting element, such as, but not limited to, wires, conductive fibers, metal strips, metal or other conducting cores, etc.

Figure 7:
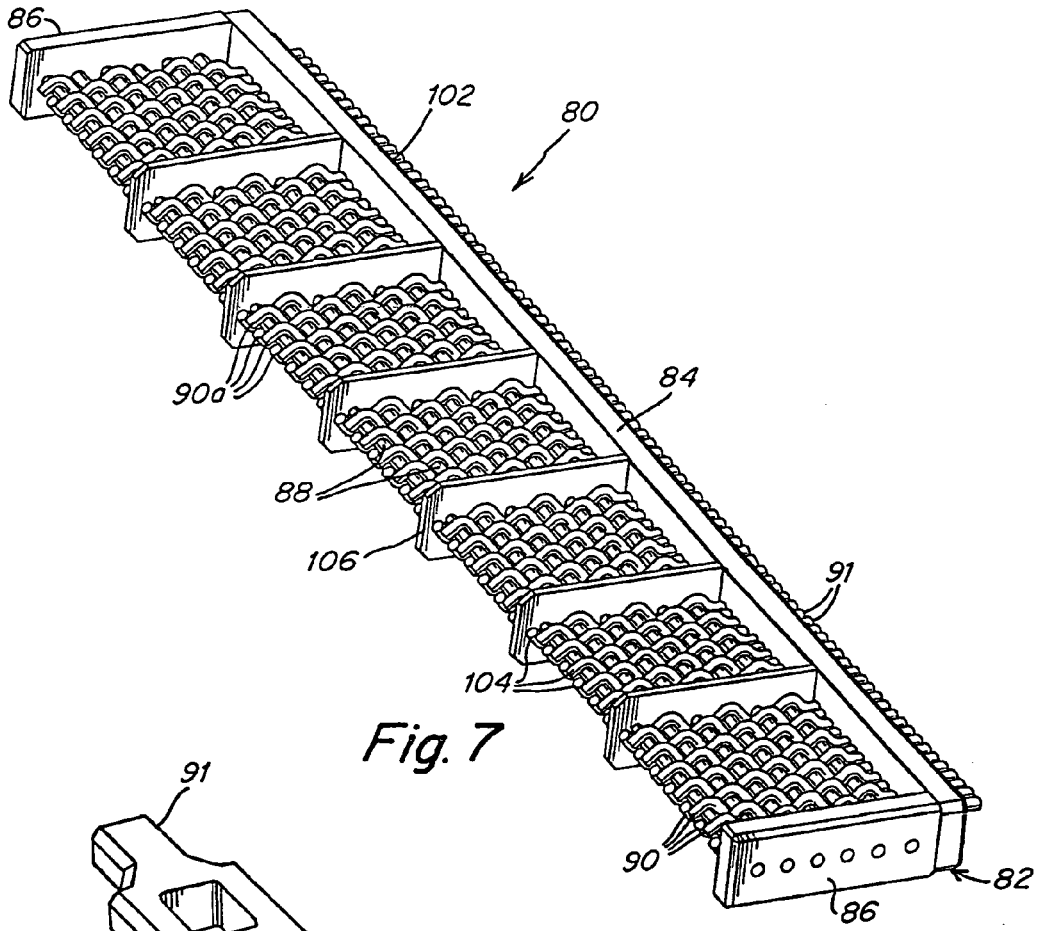
FIG. 7 is a perspective view of an embodiment of a woven connector according to aspects of the invention.

Referring to FIG. 7, there is illustrated one embodiment of a connector according to aspects of the invention. The connector 80 includes a housing 82 that may include a base member 84 and two end walls 86. A plurality of non-conductive fibers 88 may be disposed between the two end walls 86. A plurality of conductors 90 may extend from the base member 84, substantially perpendicular to the plurality of non-conductive fibers 88. The plurality of conductors 90 may be woven with the plurality of non-conductive fibers so as to form a plurality of peaks and valleys along a length of each of the plurality of conductors, thereby forming a woven connector structure. Resulting from the weave, each conductor may have a plurality of contact points positioned along the length of each of the plurality of conductors, as will be discussed in more detail below.

In one embodiment, a number of conductors 90*a*, for example, four conductors, may together form one electrical contact. However, it is to be appreciated that each conductor may alone form a separate electrical contact, or that any number of conductors may be combined to form a single electrical contact. The connector of FIG. 7 may be include termination contacts 91 which may be permanently or removably connected to, for example, a backplane or daughter board. In the illustrated example, the termination contacts 91 are mounted to a plate 102 that may be mounted to the base member 84 of housing 82. Alternatively, the terminations may be connected directly to the base member 84 of the housing 82. The base member 84 and/or end walls 86 may also be used to secure the connector 80 to the backplane or daughter board. The connector of FIG. 7 may be adapted to engage with one or more mating connector elements, as discussed below.

Figure 8:
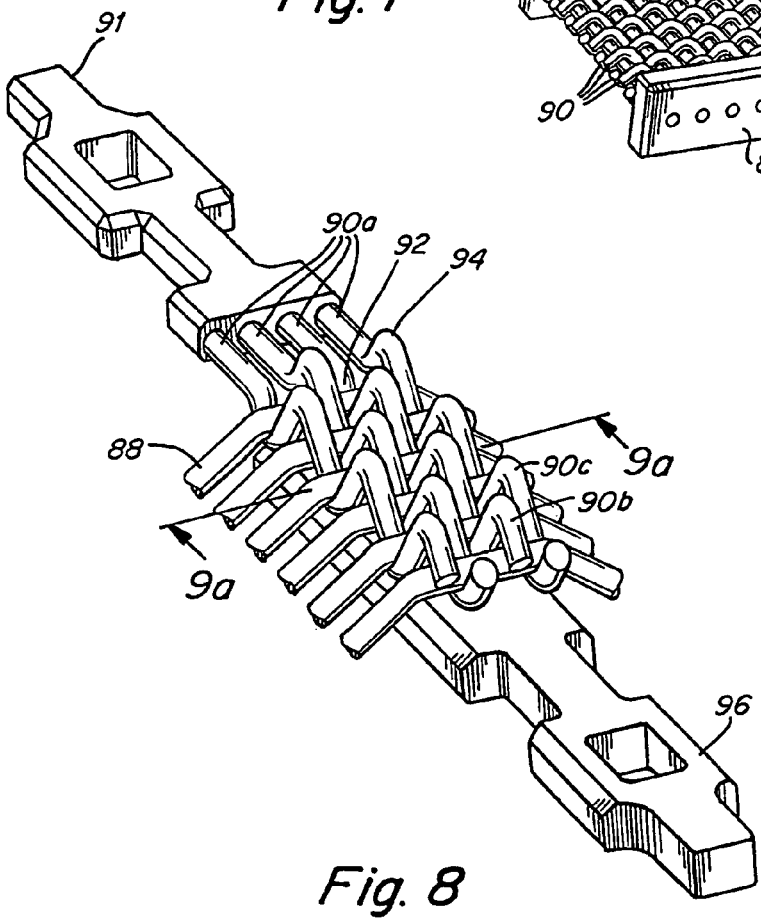
FIG. 8 is a perspective view of an example of an enlarged portion of the woven connector of FIG. 7.
Figures 15A, 15B:
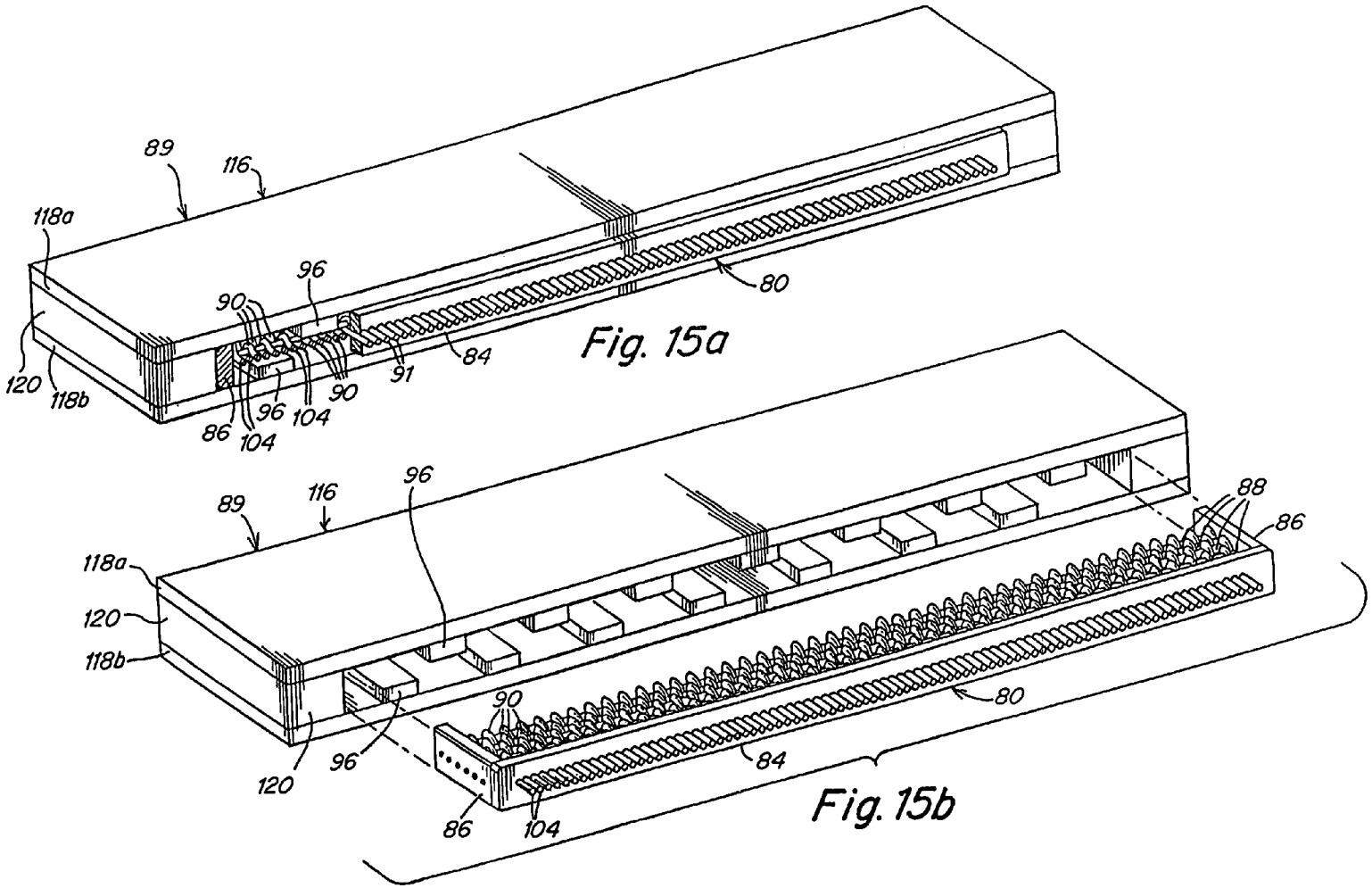
FIG. 15*a* is a perspective view of the connector of FIG. 7, mated with a mating connector element.
FIG. 15*b* is an exploded perspective view of the array of FIG. 11*a;*

FIG. 8 illustrates an example of an enlarged portion of the connector 80, illustrating one electrical contact comprising the four conductors 90*a*. The four conductors 90*a* may be connected to a common termination contact 91. It is to be appreciated that the termination contact 91 need not have the shape illustrated, but may have any suitable configuration for termination to, for example, a semiconductor device, a circuit board, a cable, etc. According to one example, the plurality of conductors 90*a* may include a first conductor 90*b* and a second conductor 90*c* located adjacent the first conductor 90*b*. The first and second conductors may be woven with the plurality of non-conductive fibers 88 such that a first one of the non-conductive fibers 88 passes over a valley 92 of the first conductor 90*b* and under a peak 94 of the second conductor 90*c*. Thus, the plurality of contact points along the length of the conductors may be provided by either the valleys or the peaks, depending on where a contacting mating connector is located. A mating contact 96, illustrated in FIG. 8, may form part of a mating connector element 97 that may be engaged with the connector 80, as illustrated in FIG. 15*b*. As shown in FIG. 8, at least some of the valleys of the conductors 90*a* provide the plurality of contact points between the conductors 90*a* and the mating contact 96. It is also to be appreciated that the mating contact need not have the shape illustrated, but may have any suitable configuration for termination to, for example, a semiconductor device, a circuit board, a cable, etc.

According to one embodiment, tension in the weave of the connector 80 may provide a contact force between the conductors of the connector 80 and the mating connector 96. In one example, the plurality of non-conductive fibers 88 may comprise an elastic material. The elastic tension that may be generated in the non-conductive fibers 88 by stretching the elastic fibers, may be used to provide the contact force between the connector 80 and the mating contact 96. The elastic non-conductive fibers may be pre-stretched to provide the elastic force, or may be mounted to tensioning mounts, as will be discussed in more detail below.

Figure 9A:
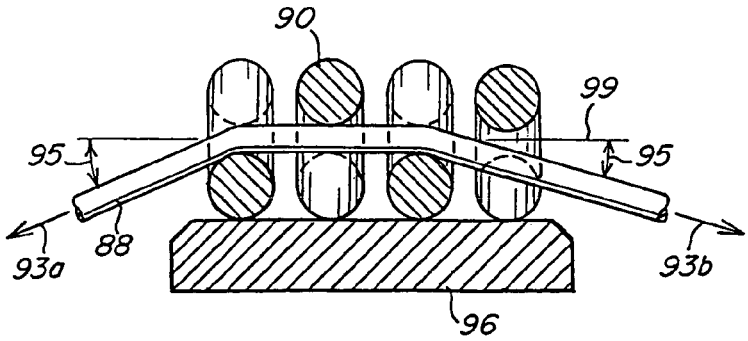
FIGS. 9*a* and 9*b* are enlarged cross-sectional views of a portion of the connector of FIG. 8.
Figure 9B:
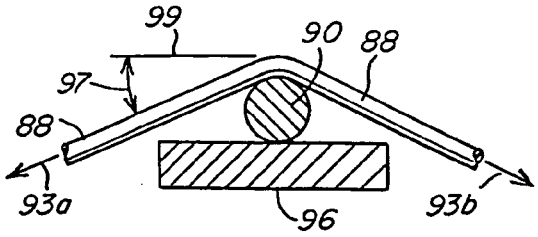

Referring to FIG. 9*a*, there is illustrated an enlarged cross-sectional view of the connector of FIG. 8, taken along line A—A in FIG. 8. The elastic non-conductive fiber 88 may be tensioned in the directions of arrows 93*a* and 93*b*, to provide a predetermined tension in the non-conductive fiber, which in turn may provide a predetermined contact force between the conductors 90 and the mating contact 96. In the example illustrated in FIG. 9*a*, the non-conductive fiber 88 may be tensioned such that the non-conductive fiber 88 makes an angle 95 with respect to a plane 99 of the mating conductor 96, so as to press the conductors 90 against the mating contact 96. In this embodiment, more than one conductor 90 may be making contact with the mating conductor 96. Alternatively, as illustrated in FIG. 9*b*, a single conductor 90 may be in contact with any single mating conductor 96, providing the electrical contact as discussed above. Similar to the previous example, the non-conductive fiber 88 is tensioned in the directions of the arrows 93*a* and 93*b*, and makes an angle 97 with respect to the plane of the mating contact 96, on either side of the conductor 90.

Figure 10:
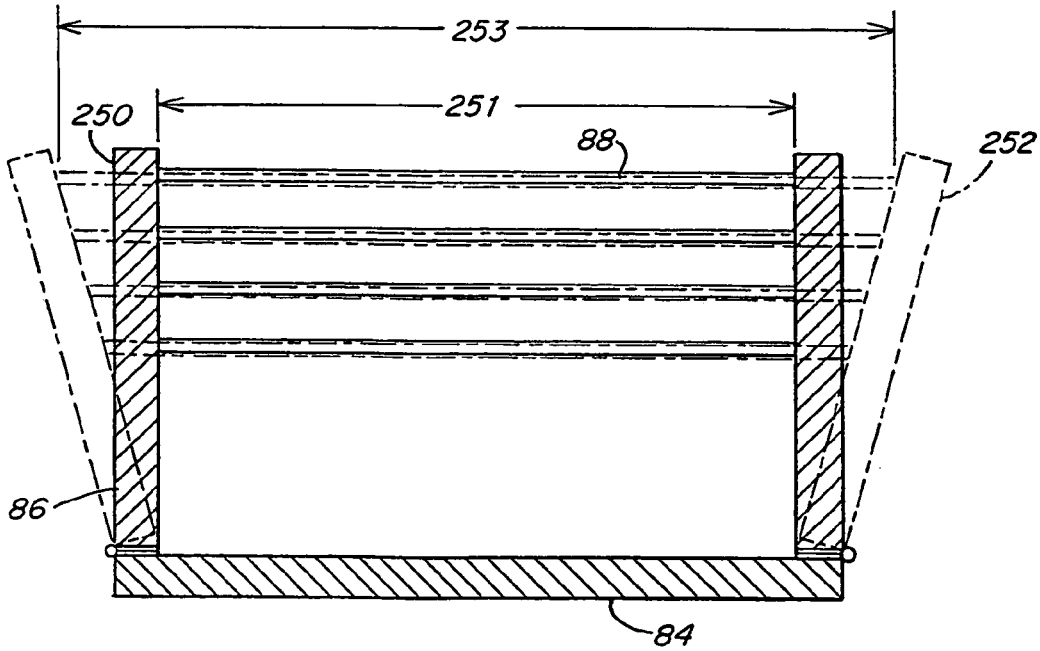
FIG. 10 is a simplified cross-sectional view of the connector of FIG. 7 with movable, tensioning end walls.

As discussed above, the elastic non-conductive fibers 88 may be attached to tensioning mounts. For example, the end walls 86 of the housing may act as tensioning mounts to provide a tension in the non-conductive fibers 88. This may be accomplished, for example, by constructing the end walls 86 to be movable between a first, or rest position 250 and a second, or tensioned, position 252, as illustrated in FIG. 10. Movement of the end walls 86 from the rest position 250 to the tensioned position 252 causes the elastic non-conductive fibers 88 to be stretched, and thus tensioned. As illustrated, the length of the non-conductive fibers 88 may be altered between a first length 251 of the fibers when the tensioning mounts are in the rest position 250, (when no mating connector is engaged with the connector 80), and a second length 253 when the tensioning mounts are in the tensioned position 252 (when a mating connector is engaged with the connector 80). This stretching and tensioning of the non-conductive fibers 88 may in turn provide contact force between the conductive weave (not illustrated in FIG. 10 for clarity), and the mating contact, when the mating connector is engaged with the connector element.

Figure 11:
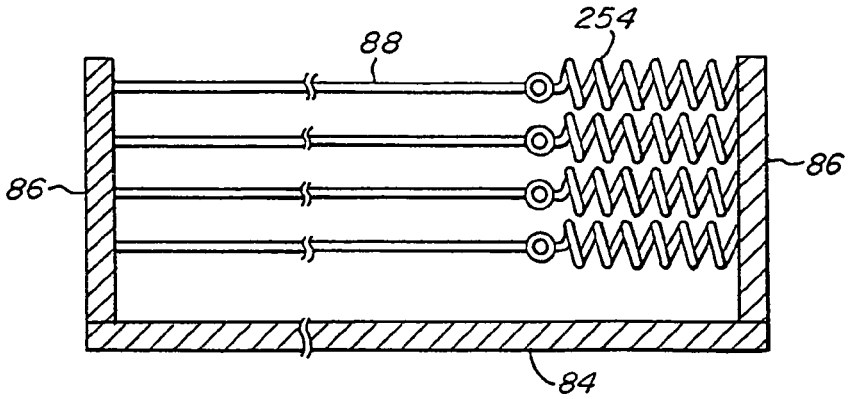
FIG. 11 is a simplified cross-sectional view of the connector of FIG. 7 including spring members attaching the non-conductive weave fibers to the end walls.
Figure 12:
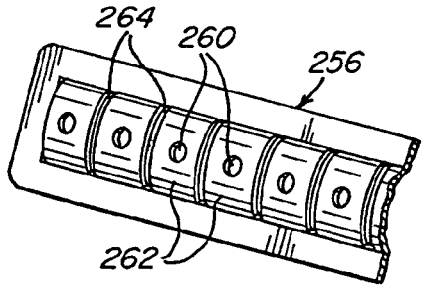
FIG. 12 is a perspective view of another example of a tensioning mount.

According to another example, illustrated in FIG. 11, springs 254 may be provided connected to one or both ends of the non-conductive fibers 88 and to a corresponding one or both of the end walls 86, the springs providing the elastic force. In this example, the non-conductive fibers 88 may be non-elastic, and may include an inelastic material such as, for example, a polyamid fiber, a polyaramid fiber, and the like. The tension in the non-conductive weave may be provided by the spring strength of the springs 254, the tension in turn providing contact force between the conductive weave (not illustrated for clarity) and conductors of a mating connector element. In yet another example, the non-conductive fibers 88 may be elastic or inelastic, and may be mounted to tensioning plates 256 (see FIG. 12), which may in turn be mounted to the end walls 86, or may be the end walls 86. The tensioning plates may comprise a plurality of spring members 262, each spring member defining an opening 260, and each spring member 262 being separated from adjacent spring members by a slot 264. Each non-conductive fiber may be threaded through a corresponding opening 260 in the tensioning plate 256, and may be mounted to the tensioning plate, for example, glued to the tensioning plate, or tied such that an end portion of the non-conductive fiber can not be unthreaded though the opening 260. The slots 264 may enable each spring member 262 to act independent of adjacent spring members, while allowing a plurality of spring members to be mounted on a common tensioning mount 256. Each spring member 262 may allow a small amount of motion, which may provide tension in the non-conductive weave. In one example, the tensioning mount 256 may have an arcuate structure, as illustrated in FIG. 12.

Figure 3A:
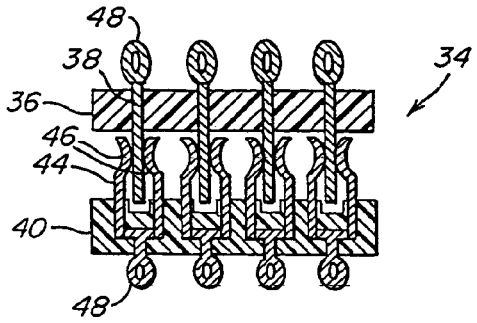
Fig. 3a (PRIOR ART)
FIG. 3*a* is a cross-sectional view of a conventional connector as may be used with the backplane assemblies of FIGS. 1, 2*a*, and 2*b;*
Figure 3B:
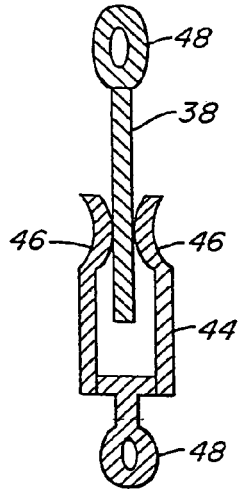
Fig. 3b (PRIOR ART)
FIG. 3*b* is an enlarged cross-sectional view of a single connection of the conventional connector of FIG. 3*a;*
Figure 4A:
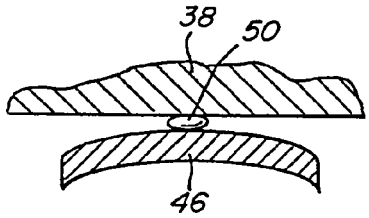
Fig. 4a (PRIOR ART)
FIG. 4*a* is an illustration of an enlarged portion of the conventional connector of FIG. 3*b*, with a particle located between a pin of the mating connector and one of the cantilevered arms of the female connector element.
Figure 4B:
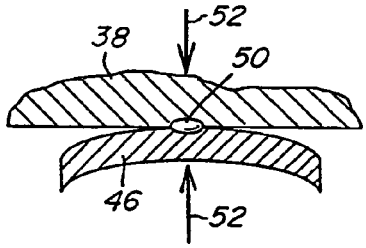
Fig. 4b (PRIOR ART)
FIG. 4*b* is an illustration of the enlarged connector portion of FIG. 4*a*, with the particle embedded into a surface of the connector.
Figure 5:
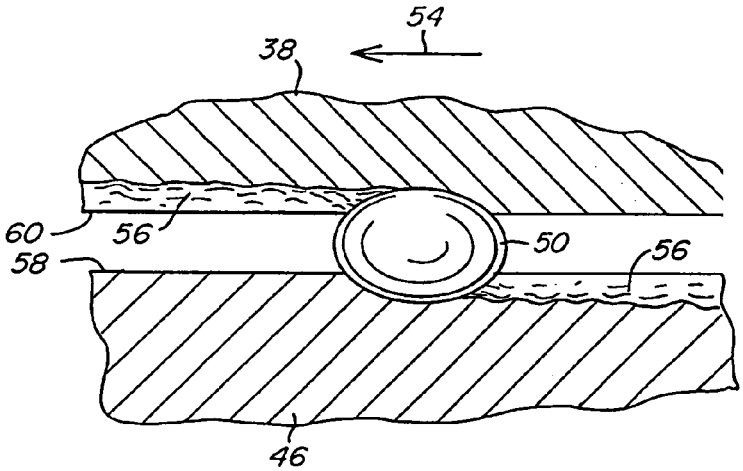
Fig. 5 (PRIOR ART)
FIG. 5 is a diagrammatic representation of an example of the plowing phenomenon.
Figure 6A:
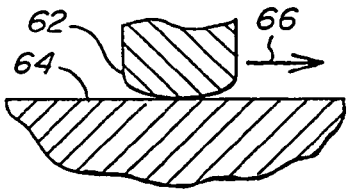
Fig. 6a (PRIOR ART)
FIGS. 6*a–g* are diagrammatic representations of particle agglomeration, with and without particle traps present in a connector.
Figure 6D:
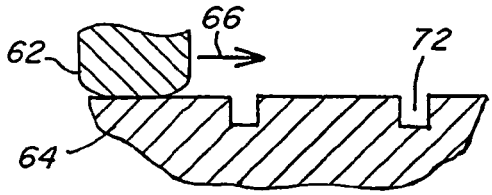
Fig. 6d (PRIOR ART)
Figure 6B:
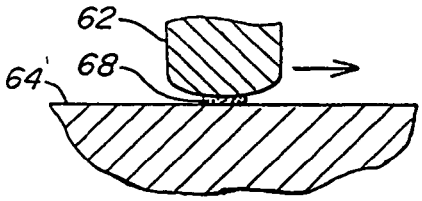
Fig. 6b (PRIOR ART)
Figure 6E:
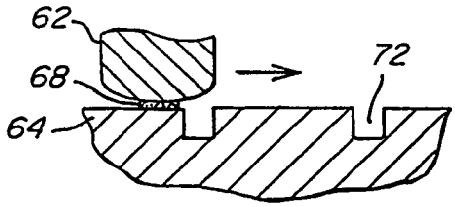
Fig. 6e (PRIOR ART)
Figure 6C:
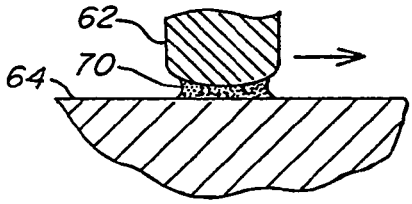
Fig. 6c (PRIOR ART)
Figure 6F:
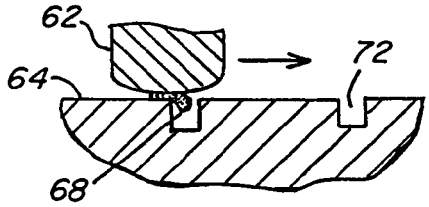
Fig. 6f (PRIOR ART)
Figure 6G:
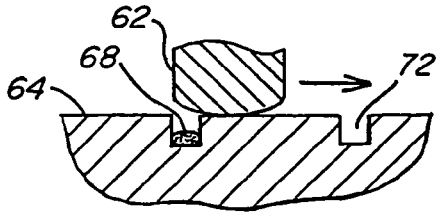
Fig. 6g (PRIOR ART)
Figure 13A:
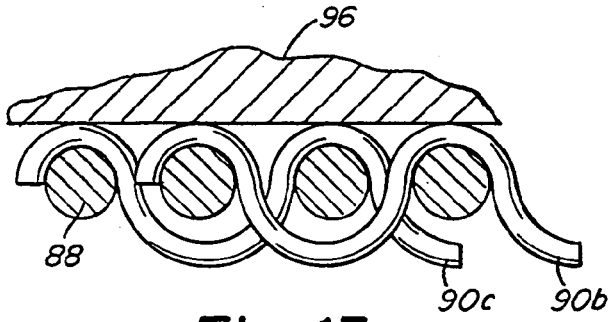
FIG. 13*a* is an enlarged cross-sectional view of the woven connector of FIGS. 7 and 8.
Figure 13B:
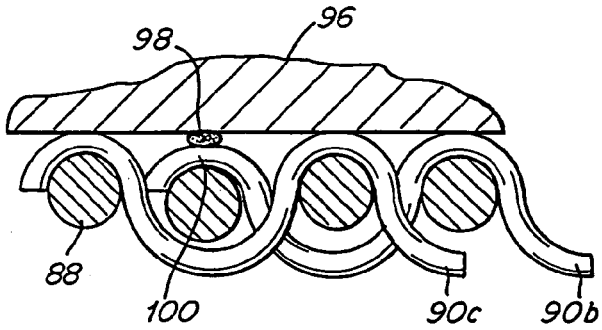
FIG. 13*b* is an enlarged cross-sectional view of the woven connector of FIGS. 7 and 8 with a particle.

According to one aspect of the invention, providing a plurality of discrete contact points along the length of the connector and mating connector may have several advantages over the single continuous contact of conventional connectors (as illustrated in FIGS. 3*a*, 3*b* and 4). For example, when a particle becomes trapped between the surfaces of a conventional connector, as shown in FIG. 4, the particle can prevent an electrical connection from being made between the surfaces, and can cause plowing which may accelerate wear of the connector. The applicants have discovered that plowing by trapped particles is a significant source of wear of conventional connectors. The problem of plowing, and resulting lack of a good electrical connection being formed, may be overcome by the woven connectors of the present invention. The woven connectors have the feature of being "locally compliant," which herein shall be understood to mean that the connectors have the ability to conform to a presence of small particles, without affecting the electrical connection being made between surfaces of the connector. Referring to FIGS. 13*a* and 13*b*, there are illustrated enlarged cross-sectional views of the connector of FIGS. 7 and 8, showing the plurality of conductors 90*a* providing a plurality of discrete contact points along the length of the mating connector element 96. When no particle is present, each peak/valley of conductors 90*a* may contact the mating contact 96, as shown in FIG. 13*a*. When a particle 98 becomes trapped between the connector surfaces, the peak/valley 100 where the particle is located, conforms to the presence of the particle, and can be deflected by the particle and not make contact with the mating contact 96, as shown in FIG. 13*b*. However, the other peaks/valleys of the conductors 90*a* remain in contact with the mating contact 96, thereby providing an electrical connection between the conductors and the mating contact 96. With this arrangement, very little force may be applied to the particle, and thus when the woven surface of the connector moves with respect to the other surface, the particle does not plow a groove in the other surface, but rather, each contact point of the woven connector may be deflected as it encounters a particle. Thus, the woven connectors may prevent plowing from occurring, thereby reducing wear of the connectors and extending the useful life of the connectors.

Figure 14:
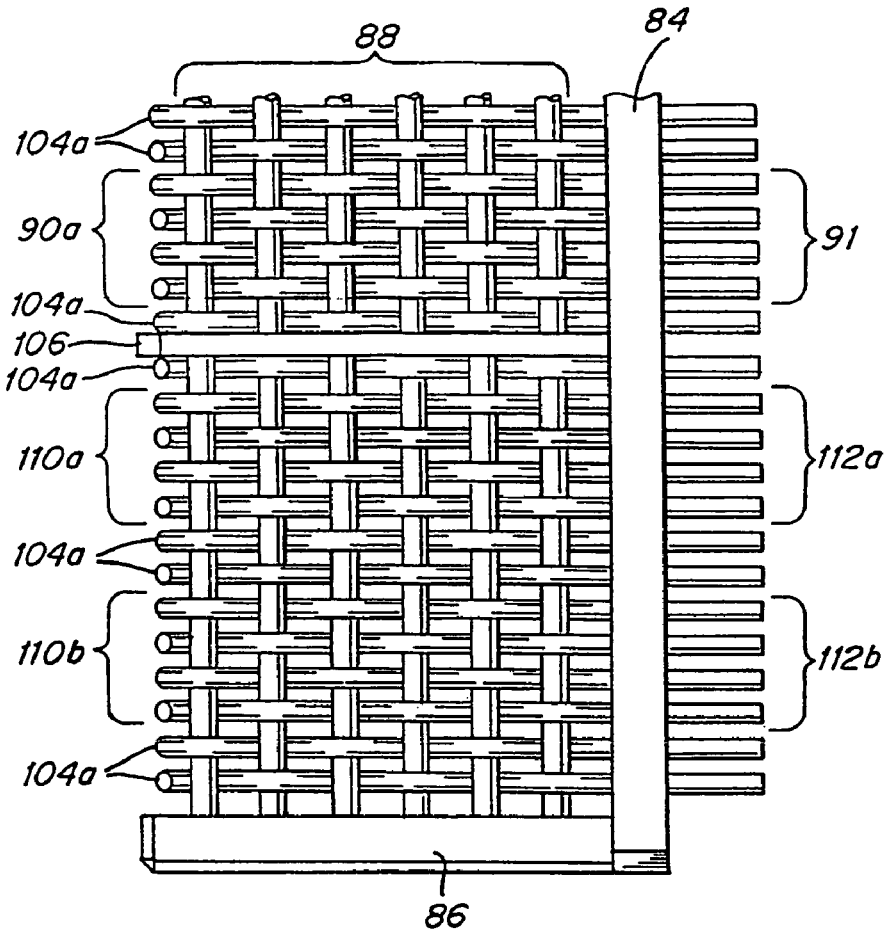
FIG. 14 is plan view of an enlarged portion of the woven connector of FIG. 7.

Referring again to FIG. 7, the connector 80 may further comprise one or more insulating fibers 104 that may be woven with the plurality of non-conductive fibers 88 and may be positioned between sets of conductors that together form an electrical contact. The insulating fibers 104 may serve to electrically isolate one electrical contact from another, preventing the conductors of one electrical contact from coming into contact with the conductors of the other electrical contact and causing an electrical short between the contacts. An enlarged portion of an example of connector 80 is illustrated in FIG. 14. As shown, the connector 80 may include a first plurality of conductors 110*a* and a second plurality of conductors 110*b*, separated by one or more insulating fibers 104*a* and woven with the plurality of non-conductive fibers 88. As discussed above, the first plurality of conductors 110*a* may be connected to a first termination contact 112*a*, forming a first electrical contact. Similarly, the second plurality of conductors 110*b* may be connected to a second termination contact 112*b*, forming a second electrical contact. In one example, the termination contacts 112*a* and 112*b* may together form a differential signal pair of contacts. Alternatively, each termination contact may form a single, separate electrical signal contact. According to another example, the connector 80 may further comprise an electrical shield member 106, that may be positioned, as shown in FIG. 7, to separate differential signal pair contacts from one another. Of course, it is to be appreciated that an electrical shield member may also be included in examples of the connector 80 that do not have differential signal pair contacts.

FIGS. 15*a* and 15*b* illustrate the connector 80 in combination with a mating connector 97. The mating connector 97 may include one or more mating contacts 96 (see FIG. 8), and may also include a mating housing 116 that may have top and bottom plate members 118*a* and 118*b*, separated by a spacer 120. The mating contacts 96 may be mounted to the top and/or bottom plate members 118*a* and 118*b*, such that when the connector 80 is engaged with the mating connector 97, at least some of the contact points of the plurality of conductors 90 contact the mating contacts 96, providing an electrical connection between the connector 80 and mating connector 97. In one example, the mating contacts 96 may be alternately spaced along the top and bottom plate members 118*a* and 118*b* as illustrated in FIG. 15*a*. The spacer 120 may be constructed such that a height of the spacer 120 is substantially equal to or slightly less than a height of the end walls 86 of connector 80, so as to provide an interference fit between the connector 80 and the mating connector 97 and so as to provide contact force between the mating conductors and the contact points of the plurality of conductors 90. In one example, the spacer may be constructed to accommodate movable tensioning end walls 86 of the connector 80, as described above.

It is to be appreciated that the conductors and non-conductive and insulating fibers making up the weave may be extremely thin, for example having diameters in a range of approximately 0.001 inches to approximately 0.020 inches, and thus a very high density connector may be possible using the woven structure. Because the woven conductors are locally compliant, as discussed above, little energy may be expended in overcoming friction, and thus the connector may require only a relatively low normal force to engage a connector with a mating connector element. This may also increase the useful life of the connector as there is a lower possibility of breakage or bending of the conductors occurring when the connector element is engaged with the mating connector element. Pockets or spaces present in the weave as a natural consequence of weaving the conductors and insulating fibers with the non-conductive fibers may also act as particle traps. Unlike conventional particle traps, these particle traps may be present in the weave without any special manufacturing considerations, and do not provide stress features, as do conventional particle traps.

Figure 16A:
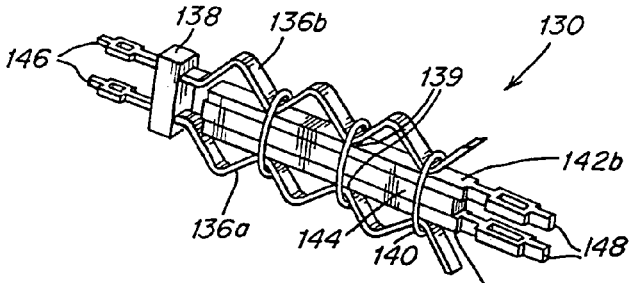
FIG. 16*a* is a perspective view of another embodiment of a connector according to aspects of the invention.
Figure 16B:
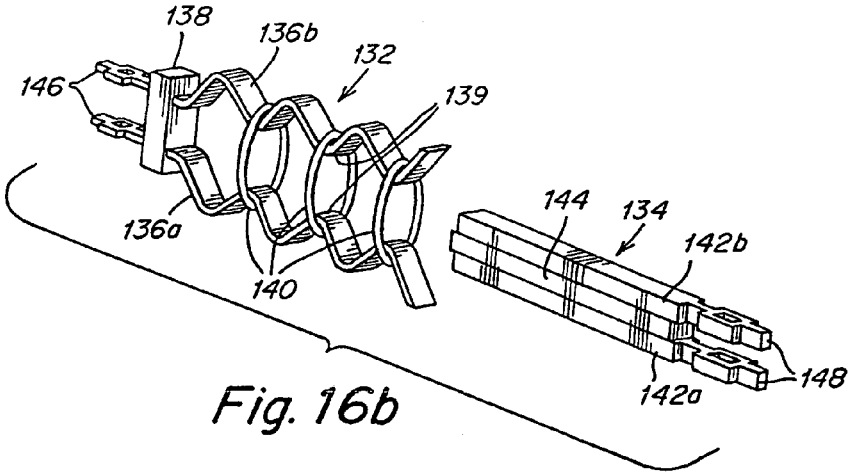
FIG. 16*b* is an exploded perspective view of the connector of FIG. 11*a;*

Referring to FIGS. 16*a* and 16*b*, there is illustrated another embodiment of a woven connector according to aspects of the invention. In this embodiment, a connector 130 may include a first connector element 132 and a mating connector element 134. The first connector element may comprise first and second conductors 136*a* and 136*b* that may be mounted to an insulating housing block 138. It is to be appreciated that although in the illustrated example the first connector element includes two conductors, the invention is not so limited and the first connector element may include more than two conductors. The first and second conductors may have an undulating form along a length of the first and second conductors, as illustrated, so as to include a plurality of contact points 139 along the length of the conductors. In one example of this embodiment, the weave is provided by a plurality of elastic bands 140 that encircle the first and second conductors 136*a* and 136*b*. According to this example, a first elastic band may pass under a first peak of the first conductor 136*a* and over a first valley of the second conductor 136*b*, so as to provide a woven structure having similar advantages and properties to that described with respect to the connector 80 (FIGS. 7–15*b*) above. The elastic bands 140 may include an elastomer, or may be formed of another insulating material. It is also to be appreciated that the bands 140 need not be elastic, and may include an inelastic material. The first and second conductors of the first connector element may be terminated in corresponding first and second termination contacts 146, which may be permanently or removably connected to, for example, a backplane, a circuit board, a semiconductor device, a cable, etc.

As discussed above, the connector 130 may further comprise a mating connector element (rod member) 134, which may comprise third and fourth conductors 142*a*, 142*b* separated by an insulating member 144. When the mating connector element 134 is engaged with the first connector element 132, at least some of the contact points 139 of the first and second conductors may contact the third and fourth conductors, and provide an electrical connection between the first connector element and the mating connector element. Contact force may be provided by the tension in the elastic bands 140. It is to be appreciated that the mating connector element 134 may include additional conductors adapted to contact any additional conductors of the first connector element, and is not limited to having two conductors as illustrated. The mating connector element 134 may similarly include termination contacts 148 that may be permanently or removably connected to, for example, a backplane, a circuit board, a semiconductor device, a cable, etc.

Figure 17A:
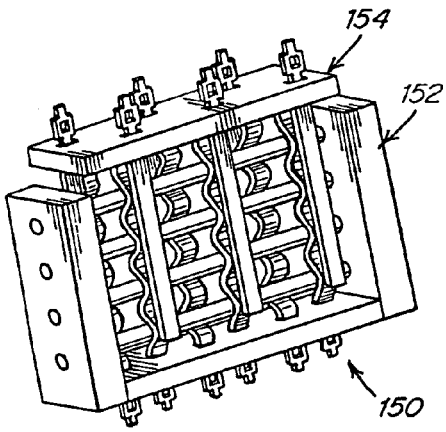
FIG. 17*a* is a perspective view of another embodiment of a connector according to aspects of the invention.
Figure 17B:
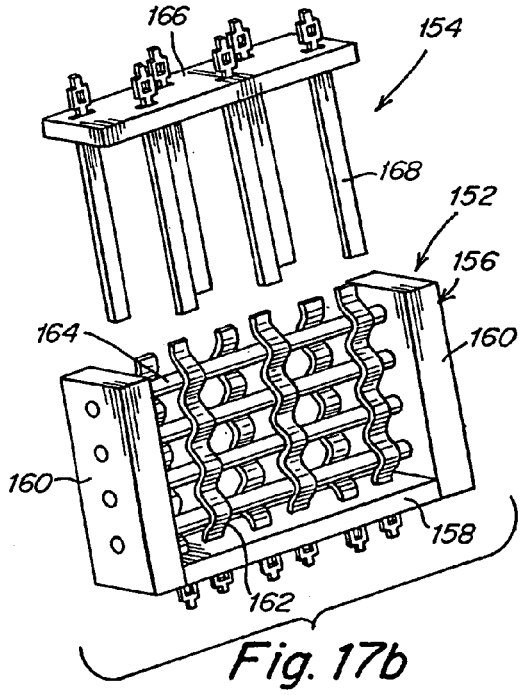
FIG. 17*b* is an exploded view of the connector of FIG. 14*a;*

An example of another woven connector according to aspects of the invention is illustrated in FIGS. 17*a* and 17*b*. In this embodiment, a connector 150 may include a first connector element 152 and a mating connector element 154. The first connector element 152 may comprise a housing 156 that may include a base member 158 and two opposing end walls 160. The first connector element may include a plurality of conductors 162 that may be mounted to the base member and may have an undulating form along a length of the conductors, similar to the conductors 136*a* and 136*b* of connector 130 described above. The undulating form of the conductors may provide a plurality of contact points along the length of the conductors. A plurality of non-conductive fibers 164 may be disposed between the two opposing end walls 160 and woven with the plurality of conductors 162, forming a woven connector structure. The mating connector element 154 may include a plurality of conductors 168 mounted to an insulating block 166. When the mating connector element 154 is engaged with the first connector element 152, as illustrated in FIG. 17*b*, at least some of the plurality of contact points along the lengths of the plurality of conductors of the first connector element may contact the conductors of the mating connector element to provide an electrical connection therebetween. In one example, the plurality of non-conductive fibers 164 may be elastic and may provide a contact force between the conductors of the first connector element and the mating connector element, as described above with reference to FIGS. 9*a* and 9*b*. Furthermore, the connector 150 may include any of the other tensioning structures described above with reference to FIGS. 10*a*–12. This connector 150 may also have the advantages described above with respect to other embodiments of woven connectors. In particular, connector 150 may prevent trapped particles from plowing the surfaces of the conductors in the same manner described in reference to FIG. 13.

Figure 18:
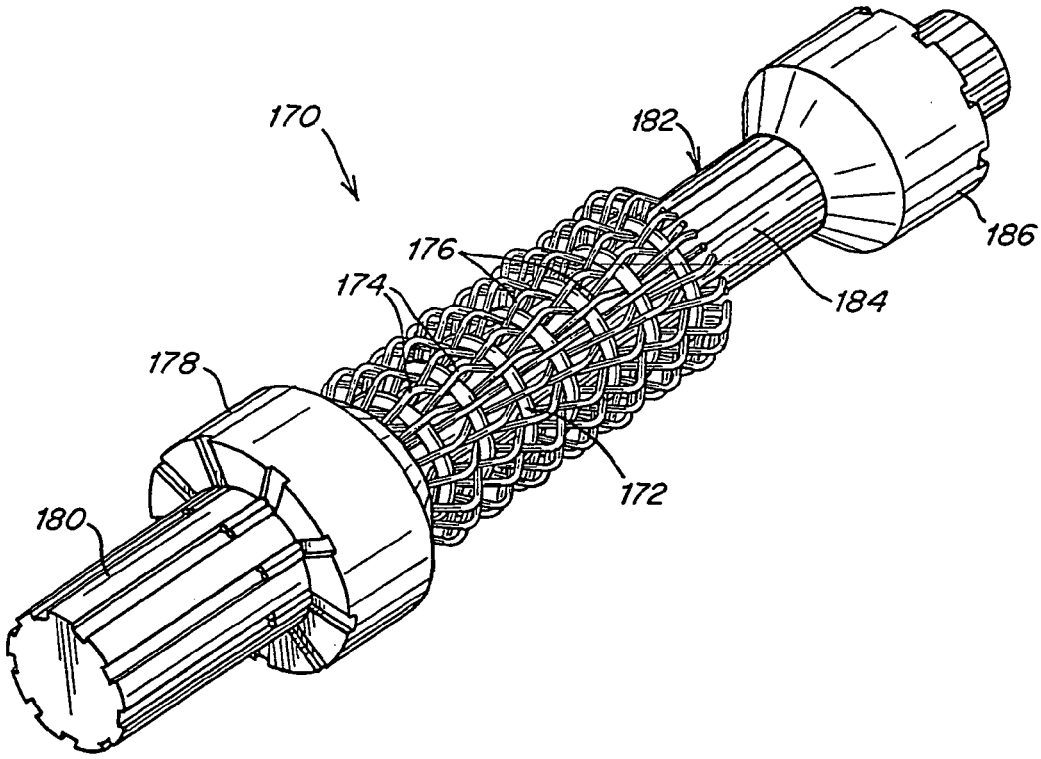
FIG. 18 is a perspective view of another embodiment of a woven connector according to aspects of the invention.

Referring to FIG. 18, there is illustrated yet another embodiment of a woven connector according to the invention. The connector 170 may include a woven structure including a plurality of non-conductive fibers (bands) 172 and at least one conductor 174 woven with the plurality of non-conductive fibers 172. In one example, the connector may include a plurality of conductors 174, some of which may be separated from one another by one or more insulating fibers 176. The one or more conductors 174 may be woven with the plurality of non-conductive fibers 172 so as to form a plurality of peaks and valleys along a length of the conductors, thereby providing a plurality of contact points along the length of the conductors. The woven structure may be in the form of a tube, as illustrated, with one end of the weave connected to a housing member 178. However, it is to be appreciated that the woven structure is not limited to tubes, and may have any shape as desired. The housing member 178 may include a termination contact 180 that may be permanently or removably connected to, for example, a circuit board, backplane, semiconductor device, cable, etc. It is to be appreciated that the termination contact 180 need not be round as illustrated, but may have any shape suitable for connection to devices in the application in which the connector is to be used.

The connector 170 may further include a mating connector element (rod member) 182 to be engaged with the woven tube. The mating connector element 182 may have a circular cross-section, as illustrated, but it is to be appreciated that the mating connector element need not be round, and may have another shape as desired. The mating connector element 182 may comprise one or more conductors 184 that may be spaced apart circumferentially along the mating connector element 182 and may extend along a length of the mating connector element 182. When the mating connector element 182 is inserted into the woven tube, the conductors 174 of the weave may come into contact with the conductors 184 of the mating connector element 182, thereby providing an electrical connection between the conductors of the weave and the mating connector element. According to one example, the mating connector element 182 and/or the woven tune may include registration features (not illustrated) so as to align the mating connector element 182 with the woven tube upon insertion.

Figure 19:
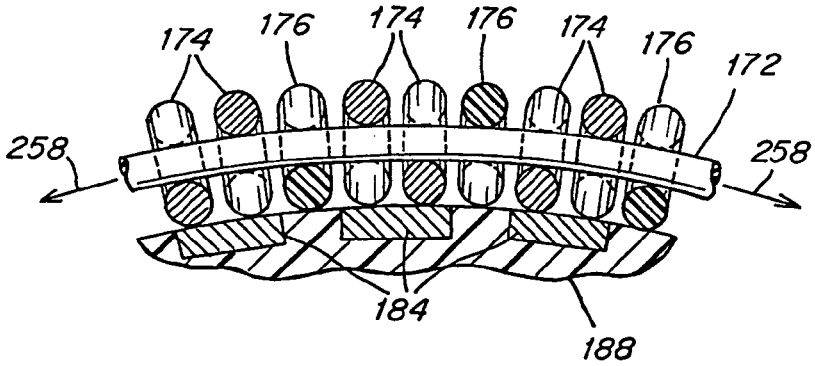
FIG. 19 is an enlarged cross-sectional view of a portion of the connector of FIG. 18.

In one example, the non-conductive fibers 172 may be elastic and may have a circumference substantially equal to or slightly smaller than a circumference of the mating connector element 182 so as to provide an interference fit between the mating connector element and the woven tube. Referring to FIG. 19, there is illustrated an enlarged cross-sectional view of a portion of the connector 170, illustrating that the non-conductive fibers 172 may be tensioned in directions of arrows 258. The tensioned non-conductive fibers 172 may provide contact force that causes at least some of the plurality of contact points along the length of the conductors 174 of the weave to contact the conductors 184 of the mating connector element. In another example, the non-conductive fibers 172 may be inelastic and may include spring members (not shown), such that the spring members allow the circumference of the tube to expand when the mating connector element 182 is inserted. The spring members may thus provide the elastic/tension force in the woven tube which in turn may provide contact force between at least some of the plurality of contact points and the conductors 184 of the mating connector element 182.

As discussed above, the weave is locally compliant, and may also include spaces or pockets between weave fibers that may act as particle traps. Furthermore, one or more conductors 174 of the weave may be grouped together (in the illustrated example of FIGS. 18 and 19, the conductors 174 are grouped in pairs) to provide a single electrical contact. Grouping the conductors may further improve the reliability of the connector by providing more contact points per electrical contact, thereby decreasing the overall contact resistance and also providing capability for complying with several particles without affecting the electrical connection.

Figure 20A:
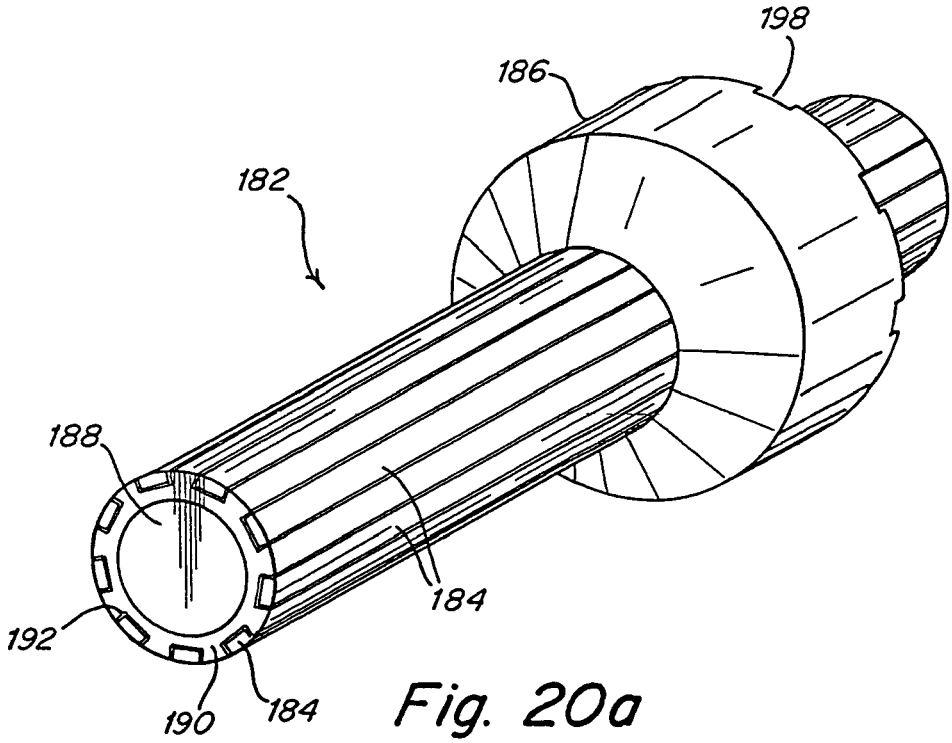
FIG. 20*a* is a perspective view of an example of a mating connector element part of the connector of FIG. 18.
Figure 20B:
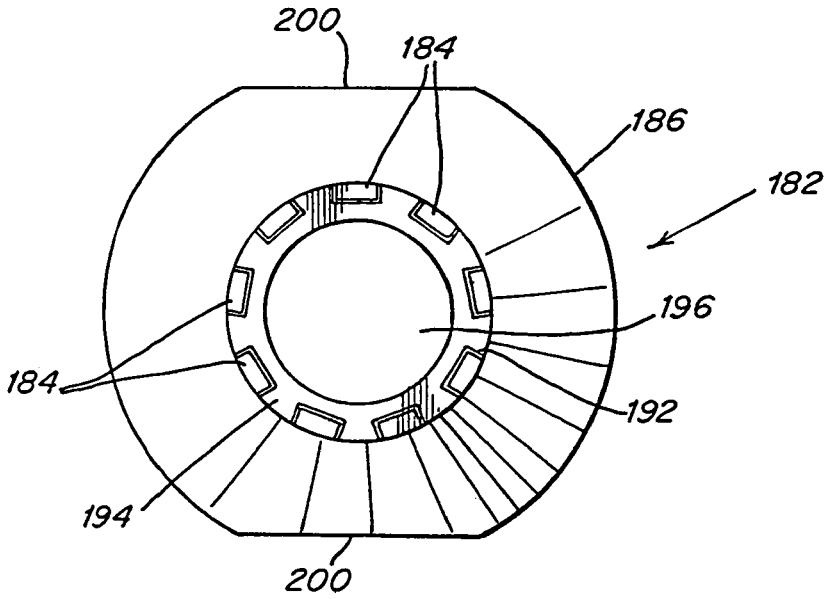
FIG. 20*b* is a cross-sectional view of another example of a the mating connector element part of the connector of FIG. 18.

Referring to FIGS. 20*a* and 20*b*, there are illustrated in perspective view and cross-section, respectively, two examples of a mating connector element 182 that may be used with the connector 170. According to one example, illustrated in FIG. 20*a*, the mating connector element 182 may include a dielectric or other non-conducting core 188 surrounded, or at least partially surrounded, by a conductive layer 190. The conductors 184 may be separated from the conductive layer 190 by insulating members 192. The insulating members may be separate for each conductor 184 as illustrated, or may comprise an insulating layer at least partially surrounding the conductive layer 190. The mating connector element may further include an insulating housing block 186.

According to another example, illustrated in FIG. 20*b*, a mating connector element 182 may comprise a conductive core 194 that may define a cavity 196 therein. Any one or more of an optical fiber, a strength member to increase the overall strength and durability of the rod member, and a heat transfer member that may serve to dissipate heat built up in the connector from the electrical signals propagating in the conductors, may be located within the cavity 196. In one example, a drain wire may be located within the cavity and may be connected to the conductive core to serve as a grounding wire for the connector. As illustrated in FIG. 20*a*, the housing block 186 may be round, increasing the circumference of the mating connector element, and may include one or more notches 198 that may serve as registration points for the connector to assist in aligning the mating connector element with the conductors of the woven tube. Alternatively, the housing block may include flattened portions 200, as illustrated in FIG. 20*b*, that may serve as registration guides. It is further to be appreciated that the housing block may have another shape, as desired and may include any form of registration known to, or developed by, one of skill in the art.

Figure 21:
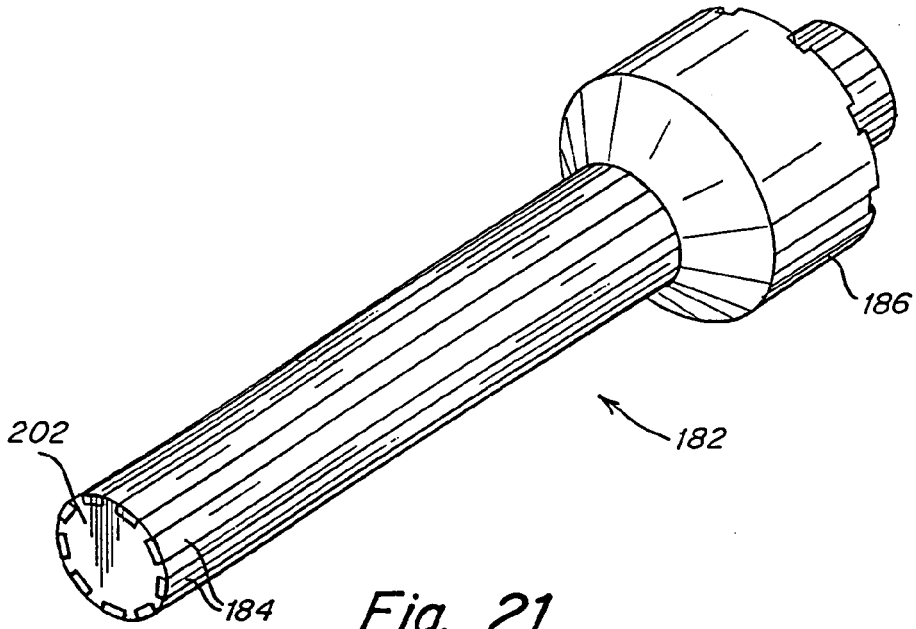
FIG. 21 is a perspective view of another example of a mating connector element that may form part of the connector of FIG. 18.

FIG. 21 illustrates yet another example of a mating connector element 182 that may be used with the connector 170. In this example, the mating connector element may include a dielectric or other non-conducting core 202 that may be formed with one or more grooves, to allow the conductors 184 to be formed therein, such that a top surface of the conductors 184 is substantially flush with an outer surface of the mating connector element.

Figure 22:
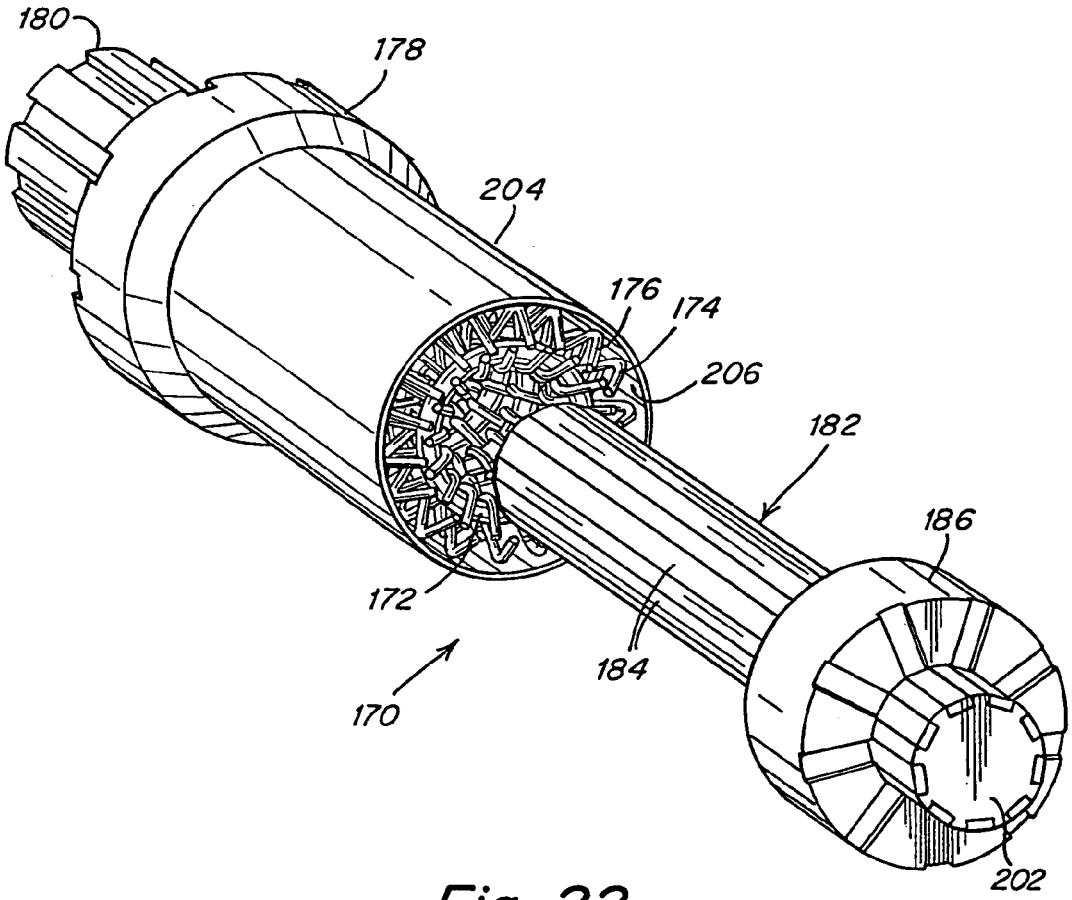
FIG. 22 is a perspective view of another example of a mating connector element, including a shield, that may form part of the connector of FIG. 18.

According to another example, illustrated in FIG. 22, the connector 170 may further comprise an electrical shield 204 that may be placed substantially surrounding the woven tube. The shield may comprise an non-conducting inner layer 206 that may prevent the conductors 174 from contacting the shield and thus being shorted together. In one example, the rod member may comprise a drain wire located within a cavity of the mating connector element, as discussed above, and the drain wire may be electrically connected to the electrical shield 204. The shield 204 may comprise, for example, a foil, a metallic braid, or another type of shield construction known to those of skill in the art.

Figure 23:
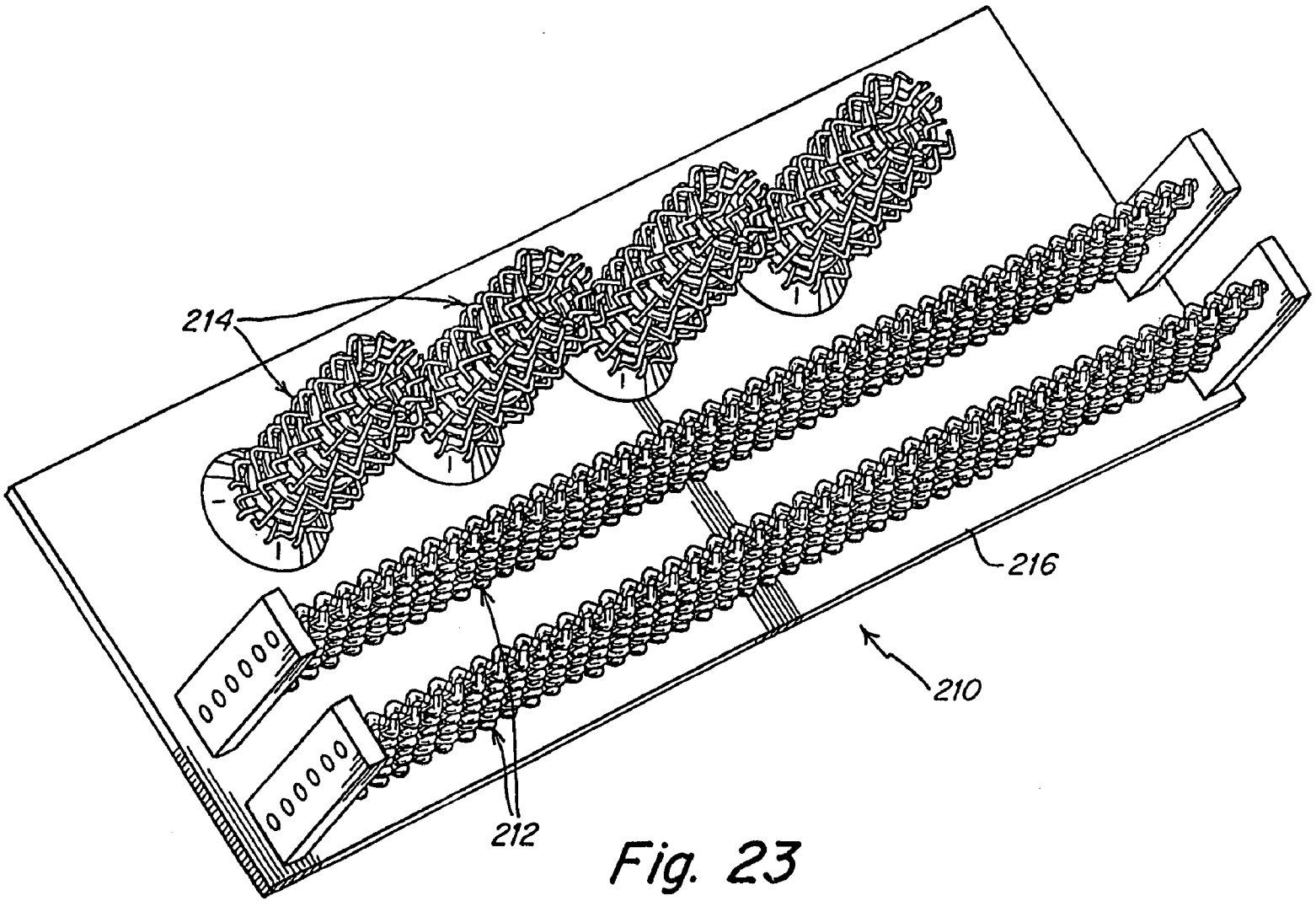
FIG. 23 is a perspective view of an array of woven connectors according to aspects of the invention.

Referring to FIG. 23, there is illustrated an example of an array of woven connectors according to aspects of the invention. According to one embodiment, the array 210 may comprise one or more woven connectors 212 of a first type, and one or more woven connectors 214 of a second type. In one example, the woven connectors 212 may be the connector 80 described above in reference to FIGS. 7–15*b*, and may be used to connect signal traces and or components on different circuit boards to one another. The woven connectors 214 may be the connector 170 described above in reference to FIGS. 18–22, and may be used to connector power traces or components on the different circuit boards to one another. In one example where the connector 170 may be used to provide power supply connections, the rod member 180 may be substantially completely conductive. Furthermore, in this example, there may be no need to include insulating fibers 176, and the fibers 172, previously described as being non-conductive, may in fact be conductive so as to provide a larger electrical path between the woven tube and the rod member. The connectors may be mounted to a board 216, as illustrated, which may be, for example, a backplane, a circuit board, etc., which may include electrical traces and components mounted to a reverse side, or positioned between the connectors (not shown).

Having thus described various illustrative embodiments and aspects thereof, modifications and alterations may be apparent to those of skill in the art. For example, the insulating fibers discussed in reference to various embodiments may include a conductive elements (e.g., a wire) covered by an insulating coating. Such modifications and alterations are intended to be included in this disclosure, which is for the purpose of illustration only, and is not intended to be limiting. The scope of the invention should be determined from proper construction of the appended claims, and their equivalents.

What is claimed is:

1. An electrical connector connecting to a mating conductor of a mating connector element, the electrical connector comprising:

a base member;

first and second conductors mounted to the base member and having an undulating form along a length of the first and second conductors so as to include a plurality of contact points along the length of the first and second conductors; and at least one elastomeric band that encircles the first and second conductors, wherein the at least one elastomeric band also encircles the conductor of the mating connector element when the electrical connector is connected to the mating connector element.

2. The electrical connector as claimed in claim 1, further comprising a mating connector clement comprising third and fourth conductors separated by an insulator, the electrical connector and mating connector element constructed such that the third and fourth conductors contact at least some of the plurality of contact points of the first and second conductors when the mating connector element is engaged with the electrical connector.

3. The electrical connector as claimed in claim 1, wherein each of the first and second conductors has a plurality of peaks and valleys positioned along the length of the first and second conductors, provided by the undulating form of the first and second conductors, and wherein the at least one elastomeric band passes over a first valley of the first conductor and under a first peak of the second conductor.

4. The electrical connector as claimed in claim 3, wherein the at least one elastomeric band is elastic and is tensioned so as to provide a contact force between the third and fourth conductors and the at least some of the plurality of contact points of the first and second conductors.

5. The electrical connector as claimed in claim 1, wherein the at least one elastomeric band that encircles the first and second conductors forms a complete loop about the first and second conductors.

6. The electrical connector as claimed in claim 1, in combination with the mating connector.

7. An electrical connector comprising:

a housing including a base member and two opposing end walls;

a plurality of non-conductive fibers mounted between the opposing end walls of the housing such that a predetermined tension is provided in the plurality of non-conductive fibers; and a first termination contact mounted to the base member and having a first plurality of conductors connected to a first end of the first termination contact, wherein the first plurality of conductors are woven with the plurality of non-conductive fibers to form a woven structure such that each conductor of plurality of conductors has a plurality of contact points along a length of each conductor.

8. The electrical connector as claimed in claim 7, wherein the plurality of non-conductive fibers are elastic and include an elastomeric material.

9. The electrical connector as claimed in claim 7, further comprising a second termination contact mounted to the base member and including a second plurality of conductors woven with the plurality of non-conductive fibers, and an insulating strand positioned between the first plurality of conductors and the second plurality of conductors to electrically isolate the first plurality of conductors from the second plurality of conductors.

10. The electrical connector as claimed in claim 9, wherein the first termination contact and the second termination contact together comprise a differential signal pair of contacts.

11. The electrical connector as claimed in claim 9, further comprising:

a third termination contact mounted to the base member of the housing and including a third plurality of conductors woven with the plurality of non-conductive fibers;

a fourth termination contact mounted to the base member of the housing and including a fourth plurality of conductors woven with the plurality of non-conductive fibers;

a second insulating strand positioned between the third and fourth pluralities of conductors; and an electrical shield mounted to the base member of the housing and located between the first plurality of conductors and the third plurality of conductors to electrically isolate the first plurality of conductors from the third plurality of conductors.

12. The electrical connector as claimed in claim 7, further comprising a mating termination contact having at least one mating conductor adapted to contact at least some of the plurality of contact points along the length of each conductor of the first plurality of conductors, wherein a contact force between the at least some of the plurality of contact points and the mating conductor is provided by the tension of the plurality of non-conductive fibers.

13. The electrical connector as claimed in claim 12, further comprising a mating housing, wherein the mating termination contact is mounted to the mating housing, the mating housing being adapted to provide a predetermined contact force between the at least one mating conductor and the at least some of the plurality of contact points of the first plurality of conductors.

14. An electrical connector connecting to a mating conductor of a mating connector element, the electrical connector comprising:

a base member;

first and second conductors mounted to the base member and having an undulating form along a length of the first and second conductors so that each includes a plurality of contact points along the length of the respective first and second conductors; and at least one elastomeric band that encircles the first and second conductors, the at least one elastomeric band producing a contact force sufficient to maintain a separable electrical connection between contact points of each of the first and second conductors and the mating conductor of the mating connector element when the electrical connector is connected to the mating connector element.

15. The electrical connector as claimed in claim 14, further comprising a mating connector element comprising third and fourth conductors separated by an insulator, the electrical connector and mating connector element constructed such that the third and fourth conductors contact at least some of the plurality of contact points of the first and second conductors when the mating connector element is engaged with the electrical connector.

16. The electrical connector as claimed in claim 14, wherein each of the first and second conductors has a plurality of peaks and valleys positioned along the length of the first and second conductors, provided by the undulating form of the first and second conductors, and wherein the at least one elastomeric band passes over a first valley of the first conductor and under a first peak of the second conductor.

17. The electrical connector as claimed in claim 16, wherein the at least one elastomeric band is elastic and is tensioned so as to provide a contact force between the third and fourth conductors and the at least some of the plurality of contact points of the first and second conductors.

18. The electrical connector as claimed in claim 14, wherein the at least one elastomeric band that encircles the first and second conductors forms a complete loop about the first and second conductors.

19. The electrical connector as claimed in claim 14, in combination with the mating connector.

* * * * *